US006497187B2

(12) United States Patent
Khinkis et al.

(10) Patent No.: US 6,497,187 B2
(45) Date of Patent: Dec. 24, 2002

(54) ADVANCED $NO_X$ REDUCTION FOR BOILERS

(75) Inventors: Mark J. Khinkis, Morton Grove, IL (US); Iosif K. Rabovitser, Skokie, IL (US)

(73) Assignee: Gas Technology Institute, Des Plaines, IL (US)

( * ) Notice: Subject to any disclaimer, the term of this patent is extended or adjusted under 35 U.S.C. 154(b) by 0 days.

(21) Appl. No.: 09/810,831

(22) Filed: Mar. 16, 2001

(65) Prior Publication Data

US 2002/0129752 A1 Sep. 19, 2002

(51) Int. Cl.[7] ..... F23B 7/00; F23K 1/00

(52) U.S. Cl. ..... 110/347; 110/342; 110/229; 110/218

(58) Field of Search ..... 110/219, 224, 110/342, 347, 229, 210, 211

(56) References Cited

U.S. PATENT DOCUMENTS

| | | | | | |
|---|---|---|---|---|---|
| 3,357,375 | A | | 12/1967 | Brophy | |
| 4,347,119 | A | * | 8/1982 | Thomas | 208/11 R |
| 4,381,718 | A | * | 5/1983 | Carver et al. | 110/347 |
| 4,385,567 | A | * | 5/1983 | Voss | 110/186 |
| 4,385,905 | A | * | 5/1983 | Tucker | 48/62 R |
| 4,402,273 | A | | 9/1983 | Nagl et al. | |
| 4,417,528 | A | | 11/1983 | Vining et al. | |
| 4,495,872 | A | * | 1/1985 | Shigaki | 110/190 |
| 4,561,363 | A | | 12/1985 | Mallek | |
| 4,592,289 | A | * | 6/1986 | Pershing et al. | 110/345 |
| 4,598,651 | A | * | 7/1986 | Flickinger et al. | 110/280 |
| 4,643,133 | A | * | 2/1987 | Dauvergne | 122/318 |
| 4,765,256 | A | | 8/1988 | Caughey | |
| 4,776,285 | A | | 10/1988 | Wallner et al. | |
| 4,831,944 | A | | 5/1989 | Durand et al. | |
| 4,848,249 | A | | 7/1989 | LePori et al. | |
| 4,859,177 | A | * | 8/1989 | Kreisberg et al. | 432/14 |
| 4,981,089 | A | | 1/1991 | Spliethoff et al. | |
| 5,205,227 | A | | 4/1993 | Khinkis et al. | |
| 5,226,375 | A | * | 7/1993 | Fukuda | 110/346 |
| 5,241,916 | A | | 9/1993 | Martin | |
| 5,279,234 | A | * | 1/1994 | Bneder et al. | 110/210 |
| 5,307,746 | A | * | 5/1994 | Khinkis et al. | 110/245 |
| 5,655,463 | A | | 8/1997 | Good | |
| 5,657,705 | A | | 8/1997 | Martin et al. | |
| 5,823,122 | A | | 10/1998 | Chronowski et al. | |
| 5,890,444 | A | * | 4/1999 | Maritn et al. | 110/346 |
| 5,957,063 | A | | 9/1999 | Koseki et al. | |
| 5,961,673 | A | * | 10/1999 | Topf et al. | 48/197 R |
| 6,024,032 | A | * | 2/2000 | Sharpe | 110/342 |
| 6,038,988 | A | * | 3/2000 | Merz et al. | 110/346 |
| 6,283,048 | B1 | * | 9/2001 | Fujinami et al. | 110/346 |

* cited by examiner

*Primary Examiner*—Ira S. Lazarus
*Assistant Examiner*—K. B. Rinehart
(74) *Attorney, Agent, or Firm*—Mark E. Fejer

(57) ABSTRACT

A method and apparatus for combustion of a solid carbonaceous material in which the solid carbonaceous material is preheated and at least a portion thereof pyrolyzed on a stoker grate disposed in the lower portion of a combustion chamber to produce pyrolysis products. Overfire oxidant is then introduced into the combustion chamber above the stoker grate to ensure complete combustion of combustibles in the products of combustion generated by combustion of the solid carbonaceous material and the pyrolysis products. Preheating and pyrolysis of the solid carbonaceous material is carried out by the introduction of a pyrolysis agent directly into the bed of solid carbonaceous material.

14 Claims, 3 Drawing Sheets

ADVANCED $NO_X$ REDUCTION FOR BOILERS

BACKGROUND OF THE INVENTION

1. Field of the Invention

This invention relates to a method for combustion of a solid carbonaceous material, in particular, solid fuels such as coal, municipal solids waste, biomass, refuse derived fuels, and the like in industrial and utility stoker boilers which are co-fired with other fuels such as gaseous, liquid and/or solid fuels. The method and apparatus of this invention provide a reduction in emissions, an increase in firing rate and possible improvements in efficiency, and a reduction in the amount of gaseous, liquid and/or solid fuel consumption for co-firing in a cost-effective manner in comparison with conventional solid fuel, waste, biomass and the like-fired industrial and utility stoker boilers.

2. Description of Prior Art

Most of the existing stoker processes and apparatuses for combustion of solid fuels, waste, biomass and the like include a combustion chamber equipped with a sloped or horizontal vibrating stoker grate that reciprocates or travels to move the fuel from the fuel inlet side of the combustor to the ash removal side of the combustor. A portion of the combustion air, generally equivalent to about 1.0 to about 1.3 of the fuel stoichiometric requirement is supplied under the stoker grate. Such combustion air is typically called undergrate air, and is distributed through the stoker grate to dry and burn the fuel present on the stoker grate. The fuel is first dried on the drying portion or drying grate of the stoker grate, then combusted on the combustion portion or combustion grate of the stoker grate. The residual fuel that primarily includes ash and carbon is then decarbonized or burned on the burnout portion or burnout grate of the stoker grate. The bottom ash is then removed through an ash pit. To assure carbon burnout, a high level of excess air, compared to the amount required for carbon burnout, is maintained at the burnout grate. In addition to other species, the products of fuel drying, combustion and burnout contain products of incomplete combustion such as carbon monoxide and total hydrocarbons, oxides of nitrogen, such as NO, $NO_2$, $N_2O$ and other nitrogen-bearing compounds such as $NH_3$, HCN and the like.

The majority of $NO_x$ evolved from the stoker grate, also referred to herein as the primary combustion zone, is believed to form from the oxidation of nitrogen-bearing compounds and a smaller portion formed from the oxidation of molecular nitrogen.

Additional air or overfire air is usually introduced above the stoker grate, referred to herein as the secondary combustion zone and mixed with the products evolved from the primary combustion zone to burn out the combustibles.

Nitrogen-bearing compounds that evolve from the fuel react with oxygen in and downstream of the secondary combustion zone, forming significant additional $NO_x$. Because of the low combustion temperatures in and downstream of the overfire air injection, most of the $NO_x$ formed in this zone is by the oxidation of nitrogen-bearing compounds (less than about 10% are formed in this zone by the oxidation of molecular nitrogen).

In most cases, a boiler is an integral part of the combustor to recover the heat generated by the combustion of the solid combustible material. In some cases, cooled flue gases from downstream of the boiler are recirculated back into the primary and/or secondary combustion zone to reduce oxygen concentration and to lower combustion temperatures and, thus, are believed to enable some decrease in oxides of nitrogen formation. Disadvantages of flue gas recirculation include generally higher concentrations of products of incomplete combustion within the flue gases and within the stack gases due to reduced combustion efficiency, reduced boiler thermal efficiency, and increased capital and operating costs.

One approach to the reduction of $NO_x$, CO, and total hydrocarbon emissions in industrial and utility boilers fired with solid fuel, waste, biomass and like-type fuels is the introduction of a fuel, such as natural gas, into the combustion products generated by the primary combustion zone.

U.S. Pat. No. 5,205,227 teaches a process and apparatus for combustion of a combustible material in which the combustible material is introduced onto a stoker grate in a combustion chamber and burned, forming a primary combustion zone. A fuel or fuel/carrier fluid mixture is supplied into the combustion chamber to create an oxygen deficient secondary combustion zone for $NO_x$ reduction and other nitrogen bearing compounds decomposition above the primary combustion zone. An oxidizing fluid is supplied into the combustion chamber above the oxygen deficient secondary combustion zone for thorough mixing with combustion products and at least partial burnout of combustibles in an oxidizing tertiary combustion zone.

A substantial amount of work has been directed to the disposal of solid waste material for the purpose of improving efficiency, reducing $NO_x$ emissions, more stable combustion and lower capital and operating costs. A substantial amount of work also has been conducted for these same reasons in connection with solid fuel fired industrial and utility boilers. See for example U.S. Pat. No. 5,957,063 to Koseki et al., which teaches a combustion system having a thermal decomposition section in which solid combustibles are thermally decomposed or partially burned so as to generate combustible gases and a combustion section in which the combustible gases are burned. The apparatus in accordance with one embodiment is a stoker-type boiler in which thermal decomposition of the solid fuel is initiated by a burner, such as a natural gas burner, disposed above the grate.

U.S. Pat. No. 5,823,122 to Chronowski et al., teaches a system for the gasification of solid biomass fuels and for combustion of the fuel gas produced therefrom comprising a gasification zone connected to a solid biomass fuel supply and to a gasification air supply, a predetermined ignition point, a pathway for conveying fuel gas from the gasification zone to the ignition point, and a combustion air injection device for mixing fuel gas and combustion air at the ignition point to initiate combustion of the fuel gas and the combustion air.

U.S. Pat. No. 5,657,705 to Martin et al., teaches a furnace for pyrolysis of solid waste material comprising a cylindrical cavity rotating around its lengthwise axis, a combustion chamber located around the cavity and injectors for introducing fuel and oxidant into the chamber.

U.S. Pat. No. 5,655,463 to Good teaches a furnace for decomposition of waste material comprising a decomposition chamber, a waste preheat chamber disposed above the decomposition chamber by which the waste material to be decomposed is preheated prior to entry into the decomposition chamber, and an afterburner chamber which operates under vacuum such that the gases and vapor from the preheat chamber and the decomposition chamber are drawn through the decomposing solid fuel.

U.S. Pat. No. 5,241,916 to Martin teaches a method for supplying combustion air during grate firings in which the primary combustion air is introduced into the fuel and secondary combustion air is introduced directly into the flow of exhaust gas and in which some of the exhaust gas is tapped off from the flow of exhaust gas and returned to the combustion process.

U.S. Pat. No. 4,848,249 to LePori et al., teaches a method and apparatus for the gasification of biomass in a fluidized bed gasifier in which the products of combustion of a fuel are passed through the distributor plate for preheating of the biomass.

Not with standing the improvements that have been made with respect to reducing pollutant emissions from utility and industrial boilers fired with solid fuel, waste, biomass and like-type fuels as exemplified by the aforementioned prior art, there remains a need for combustion processes and apparatuses which provide lower co-firing fuel consumption for the same emission reduction rate, potential for much higher emission reduction at the same co-firing fuel rate, more stable combustion, higher turndown ratio, increased firing rate and boiler thermal efficiency, and lower capital and operating costs.

SUMMARY OF THE INVENTION

Accordingly, it is one object of this invention to provide a method for combustion of a solid fuel and/or waste material which addresses the needs for further improvements as discussed hereinabove.

These and other objects of this invention are addressed by a method for combustion of a solid carbonaceous material, including solid fuels such as coal, waste, refuse derived fuels and biomass on a stoker grate in which the solid carbonaceous material is preheated and pyrolyzed in a pyrolysis zone of a stoker to form pyrolysis products, and partially devolatilized material is combusted on the stoker, forming a primary combustion zone. An oxidant is introduced into the combustion chamber downstream of, typically above, the primary combustion zone, forming a secondary combustion zone in which substantially complete combustion of the unburned products is carried out. As will be discussed hereinbelow, the solid carbonaceous material may be preheated prior to its introduction onto the stoker grate or it may be preheated after introduction into the charging zone. Introducing an overfire oxidant into the combustion chamber above the stoker grate or downstream of the primary combustion zone results in combustion of the unburned products. In accordance with a particularly preferred embodiment of this invention, preheating of the solid carbonaceous material is carried out on the stoker grate by the products of combustion from combustion of a co-fired gaseous, liquid or solid fuel which is continuously introduced directly into the solid carbonaceous material.

The method of this invention is carried out in an apparatus for combustion of a solid carbonaceous material comprising at least one wall enclosing a combustion chamber, a stoker grate disposed in a lower region of the combustion chamber, preheating means for preheating the solid carbonaceous material, and injection means for continuously introducing a pyrolysis agent into the solid carbonaceous material. In accordance with one particularly preferred embodiment of this invention, the injection means introduce the pyrolysis agent directly into the solid carbonaceous material disposed on the stoker grate.

BRIEF DESCRIPTION OF THE DRAWINGS

These and other objects and features of this invention will be better understood from the following detailed description taken in conjunction with the drawings wherein.

DETAILED DESCRIPTION OF THE PREFERRED EMBODIMENTS

Figure 1:
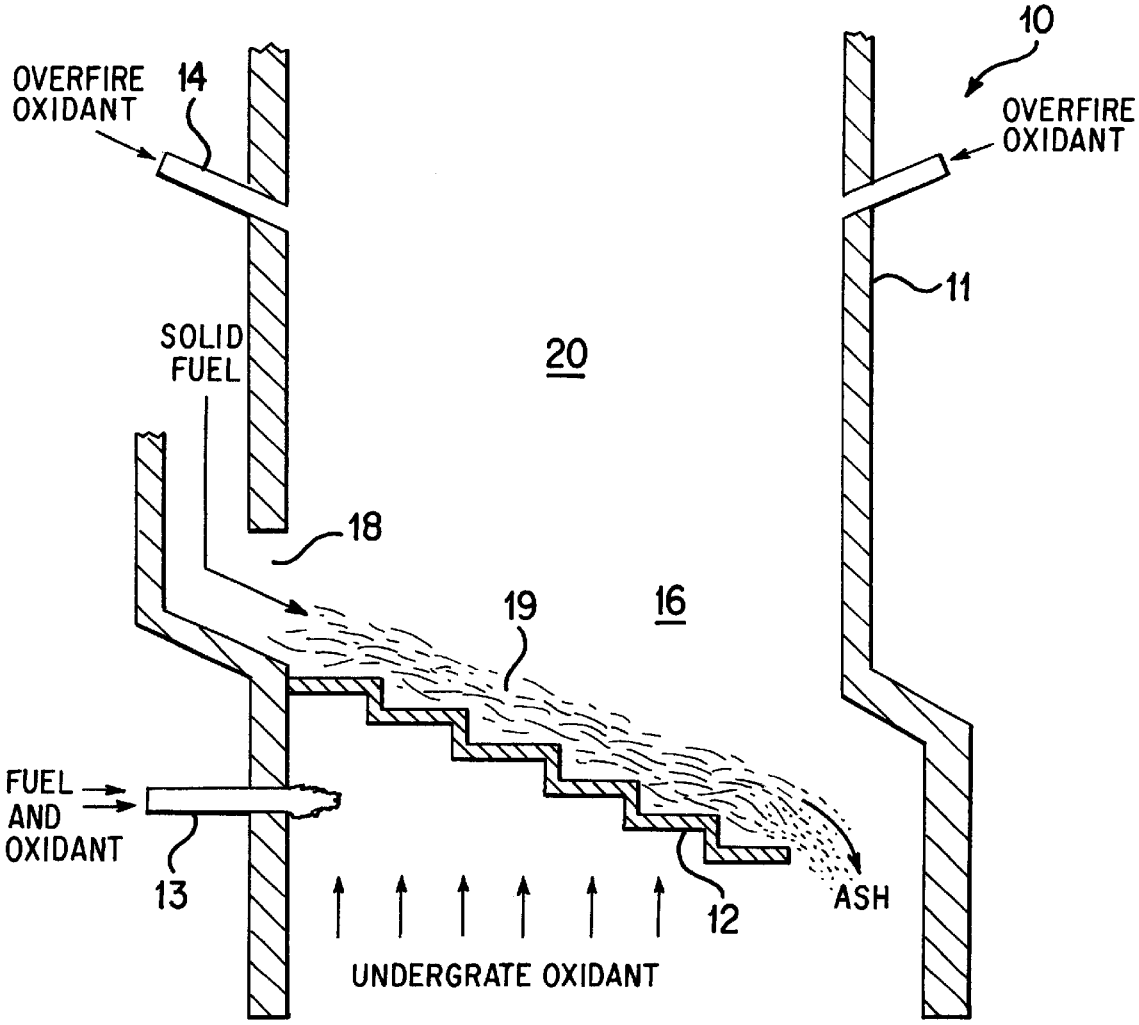
FIG. 1 is a schematic diagram of a combustion apparatus in accordance with one embodiment of this invention for carrying out the method of this invention.

As used herein, the term "solid carbonaceous material" refers to any solid, carbon-containing fuel including, but not limited to, coal, waste, refuse derived fuels, and biomass. FIG. 1 is a diagram showing a suitable apparatus in accordance with one embodiment of this invention for carrying out the method of this invention. The apparatus 10 comprises a combustion chamber wall 11 which encloses a combustion chamber 20. A stoker grate 12 is disposed in the bottom region of combustion chamber 20. Solid carbonaceous material is introduced through solid fuel inlet 18 onto stoker grate 12 to form combustible bed 19 thereon. The solid carbonaceous material introduced onto stoker grate 12 progresses along stoker grate 12 by methods known to those skilled in the art, such as vibration of the stoker grate, and is deposited as ash into an ash pit, not shown. Oxidant, known as undergrate oxidant, is provided to the solid carbonaceous material from below stoker grate 12 to provide the oxidant required for combustion of the solid carbonaceous material.

In accordance with one embodiment of the method of this invention, the solid carbonaceous material is preheated prior to introduction onto the stoker grate. At least a portion of the preheated solid carbonaceous material is then pyrolyzed. In accordance with a particularly preferred embodiment of this invention, preheating and pyrolysis of the solid carbonaceous material are simultaneously carried out on stoker grate 12. Preferably, the solid carbonaceous material is preheated to a temperature of about 1600° F.

Pyrolysis of the preheated solid carbonaceous material is accomplished by contacting the preheated solid carbonaceous material on the stoker grate 12 with a pyrolysis agent. Preferably, the pyrolysis agent comprises products of combustion derived from a co-fired solid, liquid and/or gaseous fuel. In accordance with one embodiment of this invention, the co-fired solid, liquid and/or gaseous fuel and oxidant required for combustion thereof are introduced into combustion chamber 20 beneath stoker grate 12. The combustion products then pass through stoker grate 12. A substantial portion of fuel nitrogen is removed from the solid carbonaceous fuel prior to pyrolysis on stoker grate 12. The products of pyrolysis are burned in combustion chamber 20 above stoker grate 12 by the introduction of overfire oxidant into combustion chamber 20 through overfire oxidant injector 14. As a result, significantly lower $NO_x$ levels are produced in combustion chamber 20.

To ensure continuous preheating and pyrolysis of the solid carbonaceous material, burner 13 through which the co-fired solid, liquid and/or gaseous fuel and oxidant are introduced into combustion chamber 20 are continuously fired.

Figure 2:
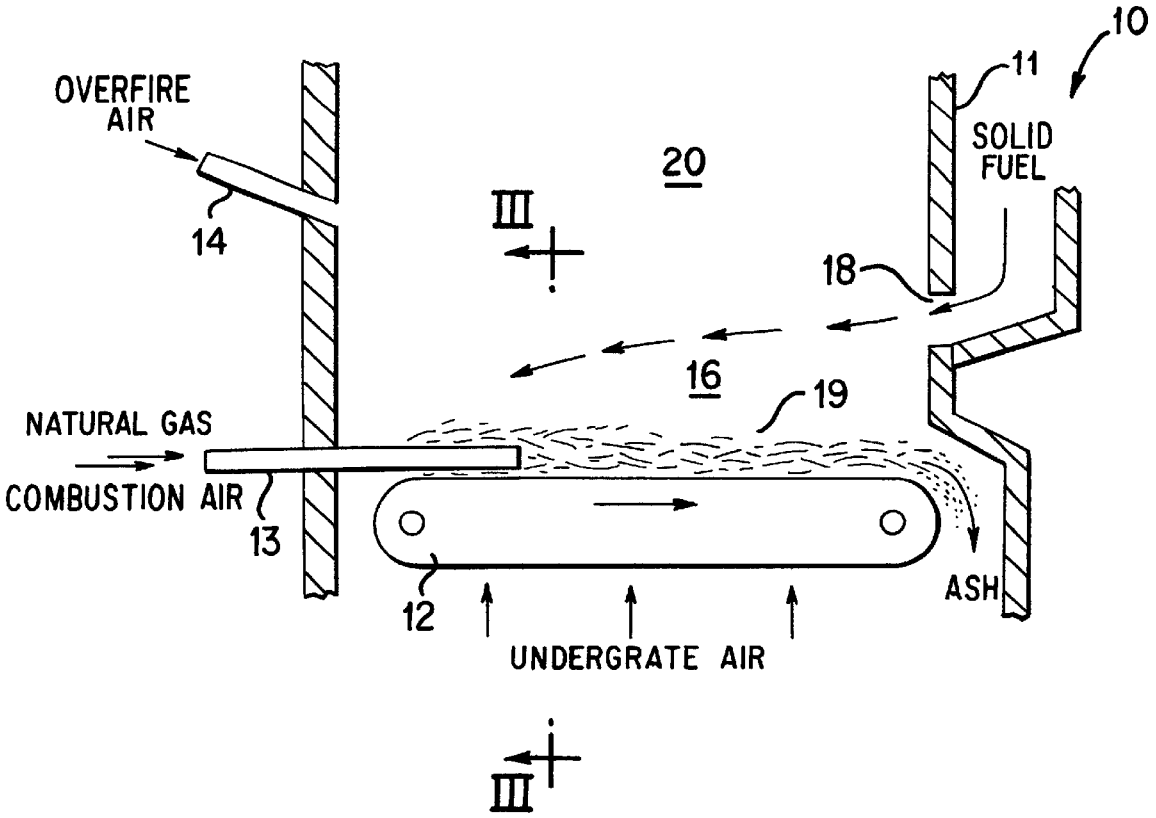
FIG. 2 is a diagram of a portion of an apparatus in accordance with one embodiment of this invention for carrying out the method of this invention.
Figure 3:
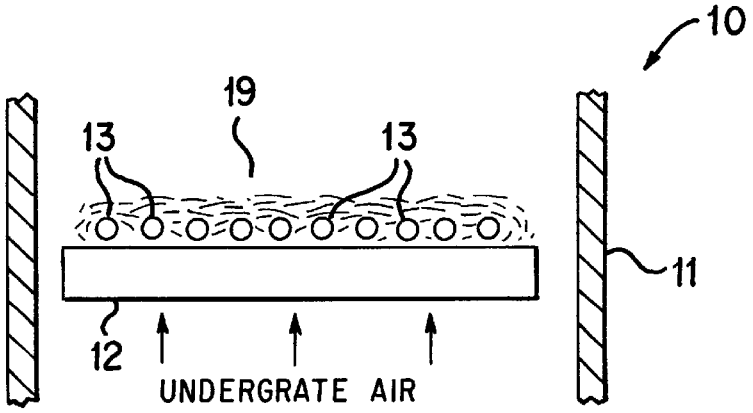
FIG. 3 is a view of the apparatus of FIG. 2 taken along the line III—III.

As shown in FIG. 2, in accordance with one embodiment of this invention, the co-fired solid, liquid and/or gaseous fuel and oxidant for preheating and pyrolysis of the solid carbonaceous material are introduced through burner 13 directly into bed 19 of the solid carbonaceous material. As shown in FIG. 3, a plurality of burners 13 are provided for introducing the co-fired fuel and oxidant into the bed of solid carbonaceous material. As in the embodiment of FIG. 1, operation of the method of this invention by injecting the co-fired solid, liquid and/or gaseous fuel and oxidant mixture directly into bed 19 of solid carbonaceous material in accordance with the embodiments of FIGS. 2 and 3 results in significantly lower $NO_x$ levels in the primary combustion zone 16 on stoker grate 12.

Figure 4:
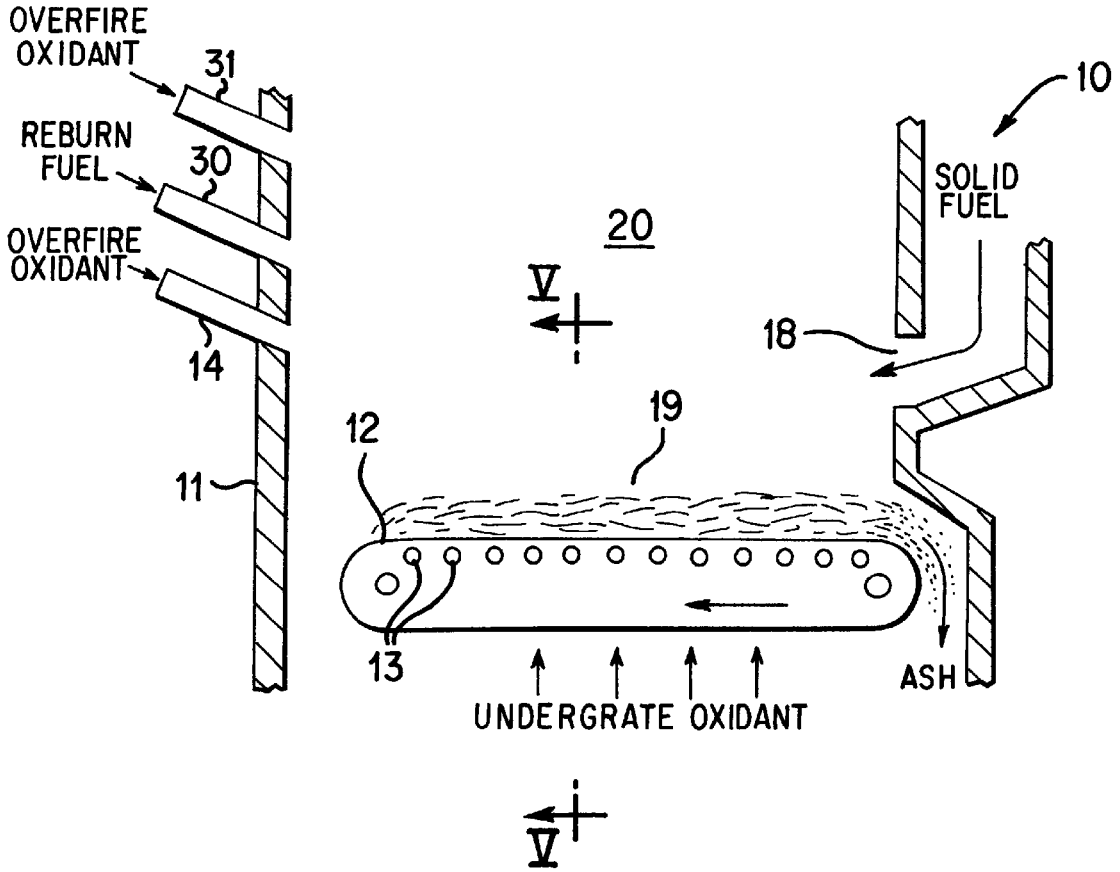
FIG. 4 is a partial cross-sectional view of an apparatus in accordance with one embodiment of this invention for carrying out the method of this invention.
Figure 5:
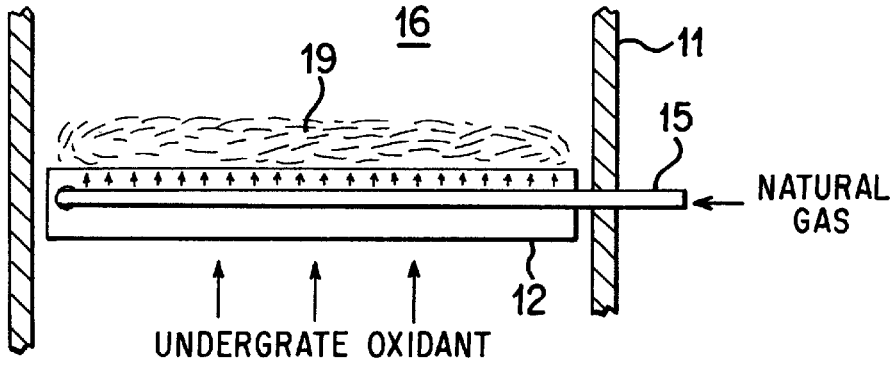
FIG. 5 is a partial cross-sectional view of the apparatus of FIG. 4 taken along the line V—V.

In accordance with another preferred embodiment of this invention, as shown in FIGS. 4 and 5, co-fired solid, liquid and/or gaseous fuel is injected into the solid carbonaceous material without additional oxidant, creating an oxidant deficient atmosphere in bed 19. Combustion stoichiometry for both the co-fired solid, liquid and/or gaseous fuel and the solid carbonaceous material preferably is maintained in the range of about 0.8 to about 1.1. Combustibles in the combustion products are burned above stoker grate 12 by the introduction of overfire oxidant through overfire oxidant injector 14 into combustion chamber 20. As a result, significantly lower $NO_x$ levels are produced on stoker grate 12.

The embodiment of FIGS. 1 and 2 in which the solid carbonaceous material is preheated and pyrolyzed by the products of combustion from a co-fired fuel/oxidant burner and the embodiment of FIGS. 4 and 5 in which only the co-fired solid, liquid and/or gaseous fuel is introduced into bed 19 may be utilized either independently of one another or in combination depending upon grate designs, solid fuel characteristics, boiler sizes, etc. In addition, the method of this invention may be effectively used in combination with conventional methane de-$NO_x$ which is described in U.S. Pat. No. 5,205,227, thermal de-$NO_x$, also referred to as selective non-catalytic reduction (SNCR) of $NO_x$, conventional solid, gaseous and/or liquid fuel co-firing, and other methods for air emissions reductions and/or performance improvement.

In accordance with one embodiment of this invention, a reburn fuel is introduced into combustion chamber 20 through at least one reburn fuel injector 30 attached to combustion chamber wall 11 above overfire oxidant injector 14, forming a reducing tertiary combustion zone, and additional overfire oxidant is introduced into combustion chamber 20 through at least one overfire oxidant injector 31 attached to combustion chamber wall 11 above said at least one reburn fuel injector 30.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method for combustion of a solid carbonaceous material comprising the steps of:

introducing said solid carbonaceous material onto a stoker grate disposed in a combustion chamber, forming a solid carbonaceous material bed on said stoker grate;

pyrolyzing at least a portion of said solid carbonaceous material on said stoker grate by continuous introduction of a pyrolysis agent into said solid carbonaceous material bed, said pyrolysis agent comprising products of combustion from substantially continuous combustion of at least one of a co-fired solid, liquid and gaseous fuel and an oxidant and said solid carbonaceous material having been preheated one of prior to said pyrolyzing and simultaneously with said pyrolyzing;

introducing undergrate oxidant into said combustion chamber, forming a primary combustion zone comprising pyrolysis products; and introducing an overfire oxidant into said combustion chamber above said stoker grate resulting in formation of a secondary combustion zone.

2. A method in accordance with claim 1, wherein said substantially continuous combustion of said at least one of co-fired solid, liquid and gaseous fuel and oxidant is carried out by continuously introducing said at least one of said co-fired solid, liquid and gaseous fuel and said oxidant directly into said solid carbonaceous material bed.

3. A method in accordance with claim 1, wherein said substantially continuous combustion of said at least one of said co-fired solid, liquid and gaseous fuel and said oxidant is carried out beneath said stoker grate.

4. A method in accordance with claim 1, wherein said solid carbonaceous material is preheated to a temperature up to about 1600° F.

5. A method in accordance with claim 1, wherein said gaseous fuel is natural gas.

6. A method in accordance with claim 1, wherein said solid carbonaceous material bed comprises an oxygen deficient zone.

7. A method in accordance with claim 1, wherein an oxidant-to-total fuel stoichiometric ratio in said primary combustion zone is in a range of about 0.8 to about 1.1.

8. A method in accordance with claim 1 further comprising introduction of a reburn fuel into said combustion chamber above said secondary combustion zone, forming a reducing tertiary combustion zone, and introducing additional overfire oxidant above said reducing tertiary combustion zone, forming an oxidizing quaternary combustion zone.

9. A method in accordance with claim 1, wherein substantially complete combustion of said pyrolysis products occurs in said secondary combustion zone.

10. An apparatus for combustion of solid carbonaceous material comprising:

at least one wall enclosing a combustion chamber;

a stoker grate suitable for holding a bed of said solid carbonaceous material disposed in a lower region of said combustion chamber;

preheating means for preheating said bed of solid carbonaceous material; and injection means for continuously introducing a pyrolysis agent into said bed of solid carbonaceous material, said injection means comprising at least one continuously firing burner disposed such that products of combustion produced by said burner are injected directly into said bed of solid carbonaceous material.

11. An apparatus in accordance with claim 10, wherein said injection means comprises of at least one continuously firing burner disposed beneath said stoker grate.

12. An apparatus in accordance with claim 10 further comprising at least one overfire oxidant injector disposed above said stoker grate and adapted to inject overfire oxidant into said combustion chamber above said stoker grate.

13. An apparatus in accordance with claim 10 further comprising at least one reburn fuel injector disposed above said at least one overfire oxidant injector and adapted to inject a reburn fuel into said combustion chamber above said overfire oxidant.

14. An apparatus in accordance with claim 13 further comprising at least one additional overfire oxidant injector disposed above said at least one reburn fuel injector and adapted to inject additional overfire oxidant above said reburn fuel.

* * * * *